US008487821B2

(12) United States Patent
Duron et al.

(10) Patent No.: US 8,487,821 B2
(45) Date of Patent: Jul. 16, 2013

(54) METHODS AND APPARATUS FOR A LOW REFLECTIVITY COMPENSATED ANTENNA

(75) Inventors: Mark Duron, East Patchogue, NY (US); Richard Knadle, Dix Hills, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 518 days.

(21) Appl. No.: 12/480,370

(22) Filed: Jun. 8, 2009

(65) Prior Publication Data

US 2010/0309068 A1 Dec. 9, 2010

(51) Int. Cl.

| | |
|---|---|
| ***H01Q 1/00*** | (2006.01) |
| ***H01Q 21/00*** | (2006.01) |
| ***H01Q 9/28*** | (2006.01) |
| ***H01Q 9/16*** | (2006.01) |

(52) U.S. Cl.

USPC ..... 343/730; 343/722; 343/793; 343/794; 343/795; 343/725; 343/726; 343/727; 343/728; 343/729

(58) Field of Classification Search

USPC ..... 343/793, 794, 795, 804, 725–730; 9/729, 9/730

See application file for complete search history.

(56) References Cited

U.S. PATENT DOCUMENTS

| | | | | |
|---|---|---|---|---|
| 5,926,150 | A * | 7/1999 | McLean et al. | 343/846 |
| 6,329,955 | B1 * | 12/2001 | McLean et al. | 343/742 |
| 7,548,167 | B2 * | 6/2009 | Yamagajo et al. | 340/572.8 |
| 7,619,579 | B2 * | 11/2009 | Rahamim et al. | 343/793 |
| 7,659,863 | B2 * | 2/2010 | Kai et al. | 343/795 |
| 7,928,921 | B2 * | 4/2011 | Kai et al. | 343/795 |
| 2003/0058184 | A1 * | 3/2003 | Barna | 343/821 |
| 2006/0208955 | A1 * | 9/2006 | Kai et al. | 343/795 |
| 2007/0152901 | A1 * | 7/2007 | Hockey et al. | 343/793 |
| 2008/0024381 | A1 | 1/2008 | Vendig et al. | |
| 2009/0096696 | A1 * | 4/2009 | Joyce et al. | 343/793 |
| 2010/0103061 | A1 * | 4/2010 | Yung et al. | 343/730 |
| 2010/0283694 | A1 * | 11/2010 | Kato | 343/730 |

FOREIGN PATENT DOCUMENTS

WO 0025385 A1 5/2000

OTHER PUBLICATIONS

International Search Report and Written Opinion for International Application No. PCT/US20100035623 mailed on Sep. 29, 2010.

* cited by examiner

*Primary Examiner* — Douglas W Owens
*Assistant Examiner* — Jennifer F Hu

(57) ABSTRACT

An antenna includes a dipole radiator region forming a series resonant tank having a first quality factor value Q1, and a loop compensator/radiator region integral with the dipole region and forming a parallel resonant tank having a second quality factor value Q2 that is substantially equal to Q2. The antenna may be a conductive sheet antenna (e.g., comprising copper tape) having a generally "A" shaped structure with a discontinuity in a middle segment.

10 Claims, 10 Drawing Sheets

METHODS AND APPARATUS FOR A LOW REFLECTIVITY COMPENSATED ANTENNA

TECHNICAL FIELD

The present invention generally relates to antenna technology, and more particularly relates to compensated antenna systems used in connection with mobile devices.

BACKGROUND

Mobile devices, such as hand-held computers, RFID readers, and the like, are used in a variety of contexts. Such devices typically include one or more antenna elements to facilitate RF communication.

Modern, high performance radio systems are capable of providing an unusually high receiver dynamic range and high receiver-to-transmitter isolation performance only if they are connected to an antenna system that possesses an extremely small S11 voltage reflection coefficient (e.g., about −30 dB) across an operating band width of, for example, three percent. A UHF mono-static RFID Reader system (one that uses a single antenna for transmitting and receiving) is one example of such a system. A CW Radar system is another example.

An antenna system that meets such stringent performance guidelines represents a considerable deviation from conventional antenna requirements. Traditionally, the Voltage Standing Wave Ratio (VSWR) and the S11 requirements are necessary metrics which assure the transmission efficiency of an antenna. For example, most resonant antennas are manufactured to a specified maximum VSWR of 2:1. This assures a transmission efficiency of at least 89%. Other more stringent antenna designs have a specified maximum VSWR of 1.5:1, which will assure a transmission efficiency of at least 96%. Very few antennas have ever been manufactured to the tighter specification for two reasons: There are very few designs that can maintain that performance over the required frequency range, and such an endeavor impacts the manufacturing yield, and thus the cost.

A relatively recent requirement has emerged for an antenna design with a reflection coefficient S11 of at least −30 dB of S11 (corresponding to a VSWR of 1.065:1) across the operating frequency range, with a worst case performance of approximately −20 dB of S11 (a VSWR of 1.22:1) at the operating band edges.

Prior art antenna designs find it difficult to meet these requirements for a variety of reasons, not the least of which is their relative narrow operating bandwidths. In order to increase bandwidth, a number of techniques known in the art have been attempted. However, these methods are unsatisfactory in that they generate unwanted heat energy, increase the volume of the antenna, decouple the radiators, and/or give rise to additional undesirable results.

Accordingly, there is a need for improved, high-bandwidth antenna systems for use with RFID readers and other mobile devices. Other desirable features and characteristics of the present invention will become apparent from the subsequent detailed description and the appended claims, taken in conjunction with the accompanying drawings and the foregoing technical field and background.

BRIEF SUMMARY

An antenna in accordance with one embodiment of the present invention includes a dipole radiator region comprising a series resonant tank having a first quality factor value Q1, and a loop compensator/radiator region integral with the dipole region and comprising a parallel resonant tank having a second quality factor value Q2 that is substantially equal to Q1. In one embodiment, the antenna is a conductive sheet antenna (e.g., comprising copper tape) having a generally "A" shaped structure with a discontinuity in a middle segment.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

DETAILED DESCRIPTION

The following discussion generally relates to improved methods and apparatus for antenna systems used in connection with mobile devices. In that regard, the following detailed description is merely illustrative in nature and is not intended to limit the invention or the application and uses of the invention. Furthermore, there is no intention to be bound by any expressed or implied theory presented in the preceding technical field, background, brief summary or the following detailed description. For the purposes of conciseness, conventional techniques and principles related to antennas, RF communication, and the like need not and will not be described herein.

Figure 1:
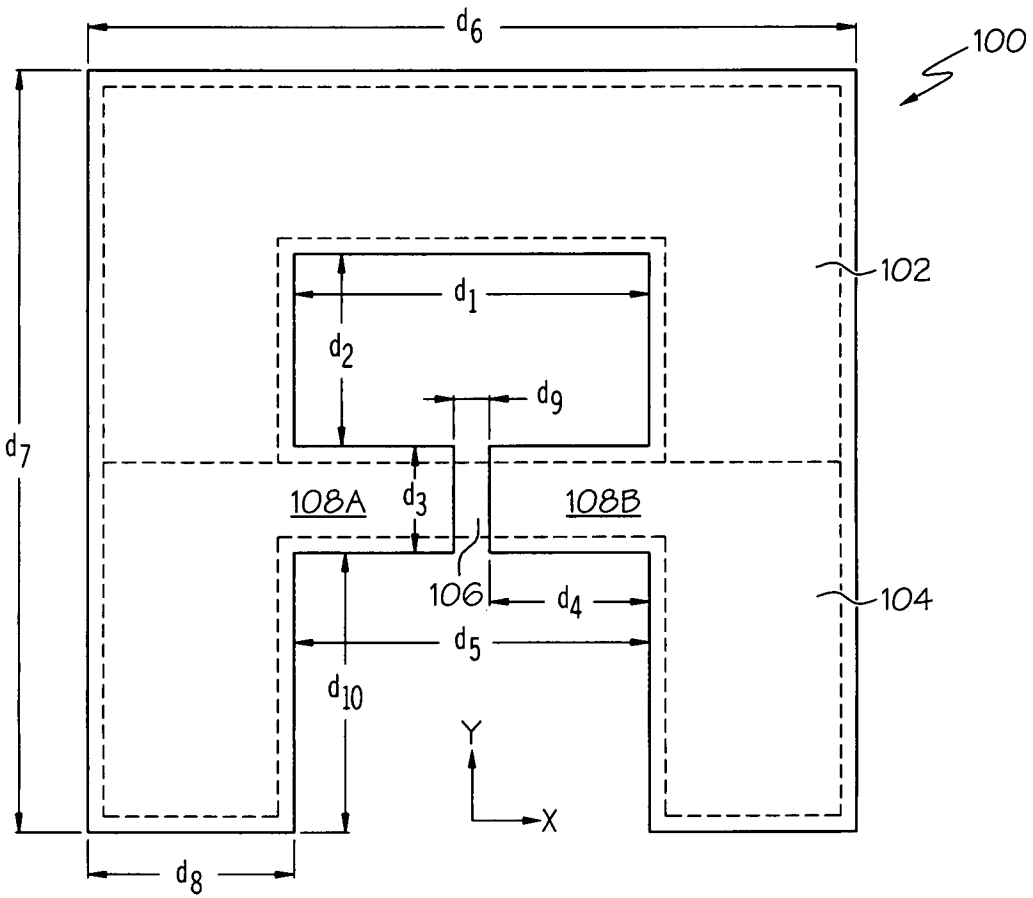
FIG. 1 is an overview of an antenna in accordance with one embodiment of the present invention.

Referring now to FIG. 1, an antenna 100 (e.g., a conductive sheet antenna) in accordance with one embodiment of the present invention generally includes a dipole radiator region 104 (bounded by a set of dotted lines) and a loop compensator/radiator region 102 (also bounded by a set of dotted lines). The two regions 102 and 104 are integral or contiguous in that they are electrically and structurally continuous and connected. For example, in typical applications antenna 100 is cut, printed, or otherwise formed from a single conductive layer of material, such as copper.

Dipole radiator region 104 acts as a series resonant tank having a first quality factor value Q1 (i.e., the absolute value of the ratio of reactance to resistance). At the same time, loop compensator/radiator region 102 acts as a parallel resonant tank having a second quality factor value Q2. In accordance with one aspect of the present invention, the two quality factors cancel each other—that is, Q1 is substantially equal to Q2. In this way, an antenna is provided which has unexpectedly high bandwidth results when there is a requirement for an S11 of approximately −30 dB.

The dipole radiator region 104 and the loop compensator/radiator region 102 preferably have a common input point. The horizontally polarized input connection will preferably be a balanced differential RF source, derived from a standard balun, that is attached to region 106 and bridges the gap between regions 108A and 108B. The S11 performance is optimized when that point of attachment is properly placed, which usually is a location that is vertically centered in region 106. There is also a pair of frequency compensating capacitors (C1 and C2 as referenced in FIG. 6) placed across gap 106, with C1 placed high (closest to region 102), and C2 placed low (farthest from region 102). To achieve a total Stationary Impedance Region (SIR) effect requires two kinds of optimization: (1) All lengths and widths such as d through d10; and (2) the three parameters of capacitor sizes (two capacitors) and the feed point location. For convenience, a printed circuit board (PCB) can be mounted in the 106 region for the purpose of mounting and containing the components C1, C2, and the current-type balun, as well as providing the interface connection between the balun output and the antenna horizontal polarization drive input point.

As illustrated in FIG. 1, the dipole radiator region 104 is generally "U" shaped (an inverted "U") having a discontinuity at the midsection. That is, a gap 106 is provided between two equal segments 108A and 108B along the midsection. In the illustrated embodiment, the dipole radiator region 104 is generally rectilinear; however, it may be curvilinear, rectilinear, or any combination thereof.

Dipole radiator region 104 has two corner regions, and the loop compensator/radiator region 102 is a generally inverted "U" shaped region whose ends intersect the two corner regions of the dipole radiator region 104. Stated another way, the dipole radiator region 104 and the loop compensator/radiator region 102 together compose, in this embodiment, a generally "A"-shaped structure. Stated another way, antenna 100 exhibits reflexional symmetry (around the Y axis as illustrated), where the leftmost portion appears as an "F", and the rightmost portion appears as a horizontally flipped "F" joined with the leftmost portion at the top.

The shape and size of antenna 100 may vary while still achieving the matched Q values described above. While the embodiment in FIG. 1 is not necessarily to scale, it is a qualitatively accurate depiction of an exemplary embodiment of the invention. The various distances (d1-d10) may be selected to achieve any particular design objectives. It should be noted that while FIG. 1 shows a rectilinear version of antenna 100, the rectilinear sections may be replaced with curved and/or tapered sections.

One rectilinear embodiment, which operates over the frequency region of 850 to 960 MHz with an S11 of −30 dB, and is constructed of 0.002 inch copper tape mounted on a sheet of 0.092 inch plastic, has the following dimensions in inches & (mm): d1=2.213 (56.21), d2=1.450 (36.83), d3=0.800 (20.32), d4=0.682 (17.32), d5=1.448 (36.78), d6=3.890 (98.81), d7=4.060 (103.12), d8=1.206 (30.63), d9=0.085 (2.16), and d10=1.100 (27.94).

Having thus given an overview of an exemplary antenna geometry, further design guidelines and approaches will now be described.

Figure 2:
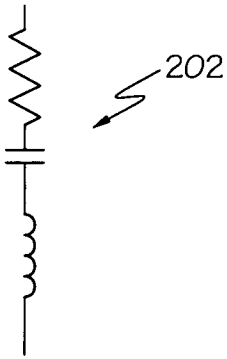
FIGS. 2-4 depict various equivalent circuits useful in understanding the present invention.
Figure 3:
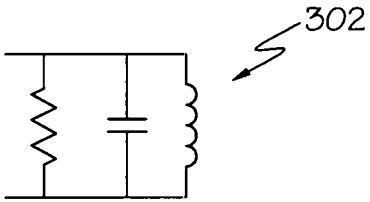
Figure 4:
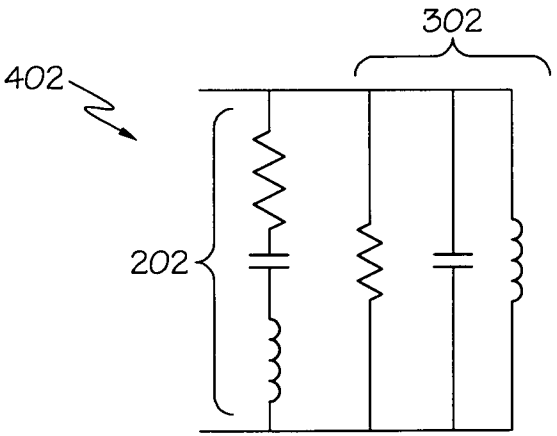

Referring now to FIGS. 2-4 in conjunction with FIG. 1, it will be appreciated that dipole radiator region 104 acts as a series L-C-R resonator 202 (FIG. 2) that simulates the dipole's fundamental resonance. This simplified circuit will generally yield a capacitive reactance in its input impedance if the applied frequency is lower than the resonant frequency—i.e., the frequency where the reactance is zero.

Compensator/radiator region 102 functions as a loop antenna that is connected onto region 104 at the approximate midpoint or corner of each half (each side) of region 104. The dominant portion of the equivalent circuit of the secondary antenna—a loop resonator/radiator—is equivalent to a parallel L-C-R resonator 302 (FIG. 3) that will acquire an inductive reactance of its input impedance if the input frequency is lower than the designed resonant frequency.

Both regions 102 and 104 are preferably fed from a common point within the antenna structure—i.e., they are essentially fed in parallel. To a first approximation, therefore, the total input impedance will remain nearly constant as the frequency is swept, as long as: (1) the two antenna regions create an opposing reactance (or susceptance) within the total antenna 100 as the input frequency deviates from the designed center frequency, thereby cancelling the reactive component, and (2) the resistive portion of the conductance of each region 102 and 104 changes in a complimentary manner as the input frequency deviates from the designed center frequency. In this way, the composite resistive component of the input impedance is essentially unchanging.

It is relatively easy to achieve the first characteristic over a limited frequency range. There are many antenna impedance matching networks that have been applied to individual antennas that have done this. However, in prior art systems, simultaneously achieving the second characteristic has proven to be more difficult for at least three reasons.

First, an examination of the simplified equivalent circuit diagrams (FIGS. 2-4) employed for each portion of the antenna will lead one to believe that the reactance build up within each portion tends to decouple the input network from the equivalent resistance that represents the radiation resistance, and the decoupling will appear to operate differently within each portion, as the applied frequency deviates from the designed center frequency. For instance, in the case of the series equivalent circuit of the Dipole portion, the simplified representation would lead one to believe that the resistive component does not change significantly. However, in the case of the typical equivalent circuit for the loop antenna region 102, the conductance component appears to change to a different value at frequencies that deviate from the design center frequency, when the components are converted to their series circuit equivalent. This type of differential change will create a condition where the resistive component (or conductive component) of each of the parallel-fed portions of the antenna will not track in a complimentary manner when the applied frequency changes. However, the Brown and Woodward curves for a Dipole do demonstrate that the resistive component is changing as the frequency is being swept about the first resonant frequency. This is true for most dipoles of a usual A/D (length to diameter) ratio. This observation suggests that the usual series-type L-C-R representative circuit for the fundamental response is overly simplistic. However, the Brown and Woodward monopole curves do demonstrate a tendency for the resistive component to be almost unchanging in the one quarter wavelength region as the A/D ratio becomes as low as 4:1—which is the limit of these curves. In this illustrated embodiment, an A/D ratio of 2.5:1 may be used, which greatly eases the task of creating a complimentary tracking of each conductance between the two parallel antenna portions.

Second, in order to create an antenna with high radiation efficiency, it preferably does not contain any ohmic (I2R) lossy components or components with dielectric loss or magnetic loss. This requirement negates the use of resistors or attenuators being added to a portion of the antenna as an attempt to create complimentary resistance (or conductance) balancing. The resistive component within the equivalent diagram that represents each region of the antenna should be due solely to the radiation resistance of that portion, and that radiation resistance (or conductance) of the two portions should track in a complimentary manner as the applied frequency is deviated from the designed center frequency.

Finally, due to the close proximity of the two regions of the antenna, there is significant cross-coupling between each radiation resistance (or conductance), as well as each radiation reactance (or susceptance). Therefore, part of the design procedure involves choosing the proper spacing between the two radiating portions of the antenna 100 so as to derive the required magnitude of cross coupling that will yield the complimentary tracking.

Figure 7:
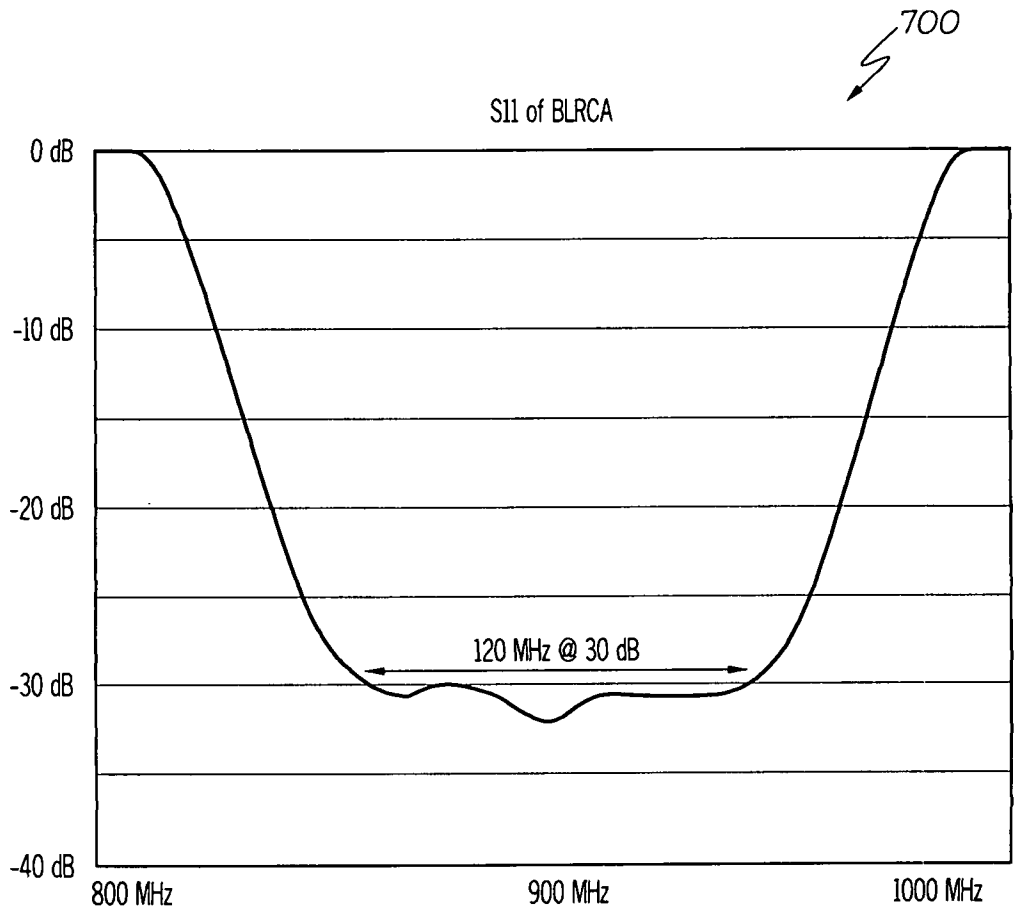
FIG. 7 is a plot showing exemplary response of an antenna in accordance with one embodiment.

In order for a candidate antenna to meet the desired requirements, the composite antenna impedance should present a voltage reflection coefficient (S11) of better than −30 dB across the desired frequency region (e.g., as shown in plot 700 of FIG. 7). To do so generally requires that the impedance start out at nearly 50 ohms resistive (for example), with nearly zero reactance, and maintain that impedance across the frequency region.

Figure 5:
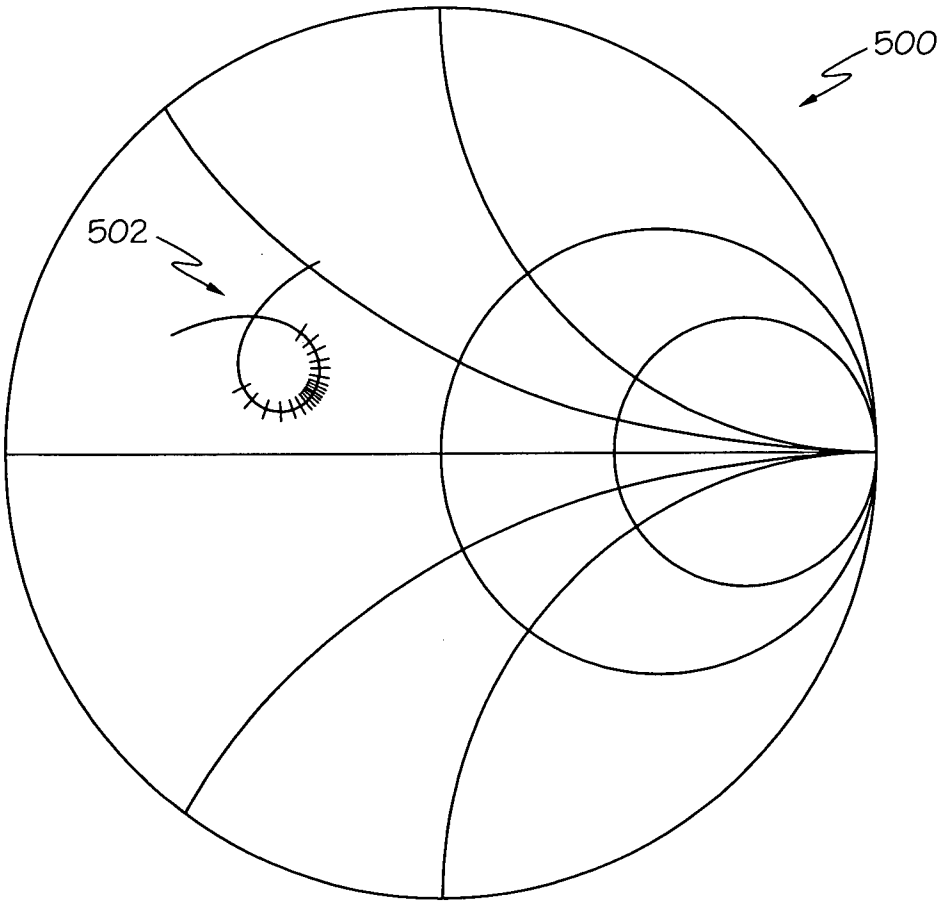
FIG. 5 is a plot showing an exemplary curve illustrating an SIR effect.

The present inventors have observed that certain composite, wide sheet metal, paired antenna configurations can be made to display an unusual characteristic when the complex input impedance is viewed on a swept-frequency Smith Chart display that is part of a well-calibrated Vector Network Analyzer (VNA). More particularly, within certain frequency regions it was noted that the display demonstrates a small circle, or a series of small circles (e.g., pattern 502 in the conceptual display 500 of FIG. 5).

When proper antenna tuning procedures were applied, the diameter of the circles would decrease to a near-vanishing size. When frequency markers were added to the display, it became evident that the display was not moving in certain regions, even though the applied frequency was traversing a considerable frequency range, which can be referred to as the Stationary Impedance Region (SIR) effect.

It was discovered that an SIR is very desirable, regardless of where on the Smith Chart it lies. Logically, it would be most desirable for the SIR to occur at the center of the chart (the 50 ohm point, for instance). Unfortunately many antenna configurations represent a compromise between antenna size, and the closeness that the SIR can be made to fall near the center of a 50 ohm Smith chart.

It was further discovered that the complex impedance of an SIR can be moved to the center of the Smith Chart by the application of a low Q, external, impedance matching network that can be added to the input Balun structure. The antenna in this first embodiment is a balanced antenna that requires a current-type balun in order to be compatible with the typical unbalanced coaxial-type transmission line.

It was discovered that if the Q of the external impedance matching network was made low enough it would only have a minor affect on the quality of the SIR affect. Usually, only a minor retuning of the antenna was required to restore the quality of the SIR after the impedance matching network was added. An example of the magnitude of the SIR affect was demonstrated by one embodiment of the antenna 100 that has nearly 100% radiation efficiency, and a −30 dB S11 bandwidth of 13%. This is a 24:1 improvement ratio over the response of a typical Dipole antenna that usually has a −30 dB S11 band width of 0.5%.

Figure 8:
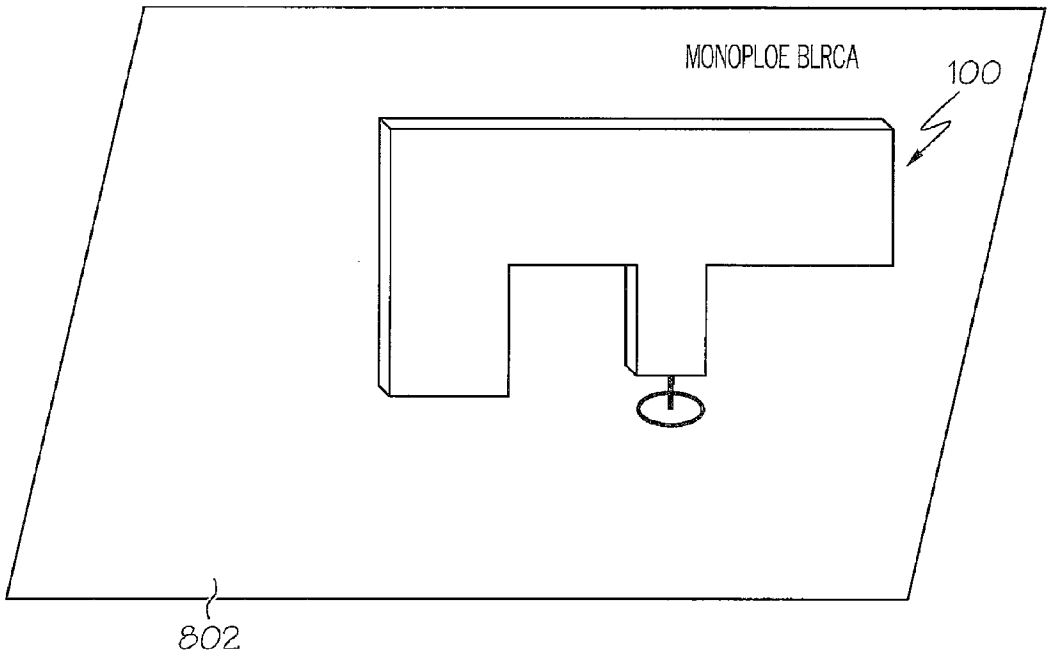
FIG. 8 depicts a monopole embodiment of the present invention.

The antenna of FIG. 1 exhibits a left and right side symmetry—i.e., reflexional symmetry about the Y-axis as illustrated. Thus, as depicted in FIG. 8, traditionally in such situations a conductive plane 802 can be placed parallel to the axis of symmetry, normal to the antenna 100. Conductive plane 802 can be referred to as the "ground plane." By using one half of antenna 100 in conjunction with ground plane 802, the resultant antenna can be called a monopole antenna (as apposed to a dipole-like antenna). The major portions of electrical performance of the monopole antenna will remain unchanged, with the exception that the magnitude of all input impedance measurements (resistance and reactance) will be approximately divided by two. The compensated antenna and the presence of the conductive plane makes a change in the magnitude of the radiated RF field that is coupled from the dipole section to the loop compensator section. Thus, it is desirable to perform some retuning of the shape parameters and component values in order to restore the SIR effect.

The monopole antenna of FIG. 8 will resemble a printed F Antenna (PIFA). However, most PIFA antennas have a sheet metal radiator section that is primarily parallel to the local ground plane. In one embodiment, the monopole antenna differed by having a sheet metal radiator that was primarily perpendicular to the ground plane, while providing a −30 db S11 band width that is approximately 24 times greater than the usual PIFA. A variation of the monopole antenna of FIG. 8 may be constructed with a conductive metallic surface that is primarily parallel to the ground plane 802.

In various embodiments of the antenna 100 illustrated in FIG. 1 the width d8 was relatively large (e.g., approximately 0.15 wavelength), particularly by the standards of conventional antennas designed to operate, for example, in the UHF frequency range. The widths of various regions within the antenna may be selected for the purpose of maximizing the opposing impedance characteristic that creates the SIR affect. This means that the current density within most of the metallic conductive regions 102, 104 of the antenna—particularly the inner regions of the wide and flat conductors—is extremely small.

Thus, antenna 100 is capable of yielding a high radiating efficiency, even though the antenna might be constructed of materials that have a rather poor electrical conductivity. This operational characteristic will allow a designer to choose previously unusable materials (such as stainless steel, a high resistivity material) that have other desirable characteristics—such as mechanical strength, impact resistance, thermal conductivity, low weight, resistance to rust, the ability to survive repeated deflections, certain meta materials, optically anechoic materials, materials with a controlled optical absorptivity to emissivity (A/E) index, high temperature materials, and the like.

Figure 9:
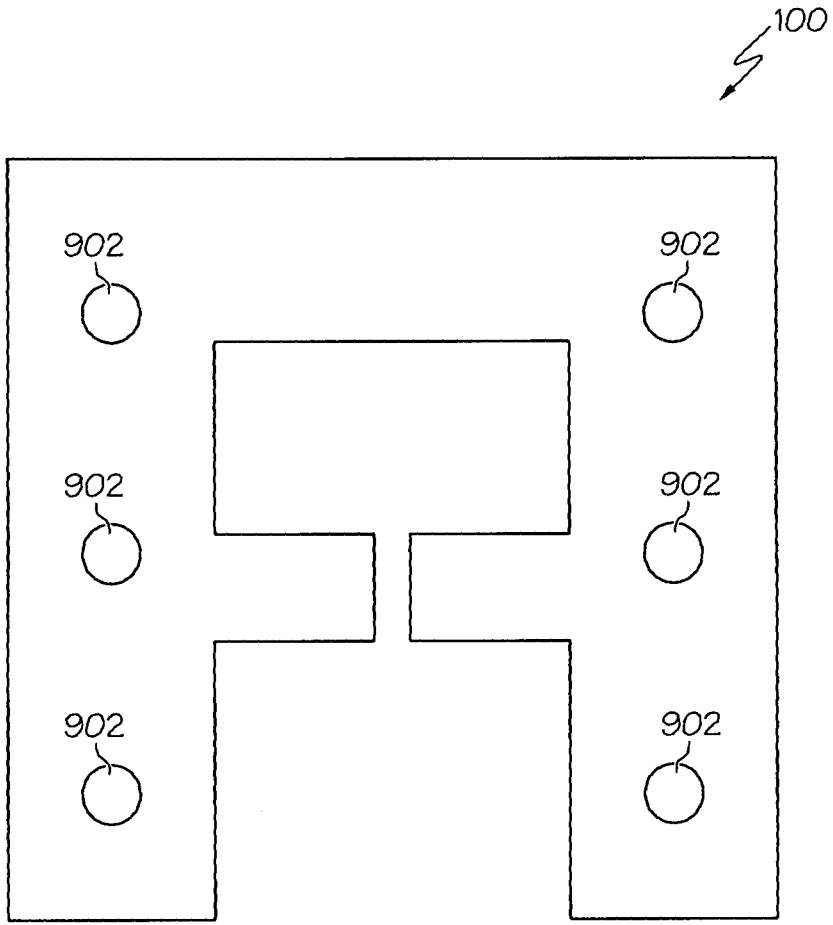
FIG. 9 illustrates the antenna of FIG. 1 including a plurality of openings.

In an alternate embodiment, antenna 100 includes one or more openings or holes cut into the center of its sides—i.e., the areas of low current density. Such an embodiment is shown in FIG. 9, which depicts six openings 902 within the vertical sides as illustrated. This embodiment exhibits high radiation efficiency and no significant detriment to the SIR affect, perhaps because openings 902 represent a type of wave guide that is beyond the cut off frequency. The openings, which may be any suitable shape, may also accommodate mounting screws or provide better bonding of the layers of injection molded rubber that can be used to protect antenna 100.

Antenna 100 of FIG. 1 is a generally planar structure; however, the invention is not so limited. The various geometric shapes may be curvilinear, rectilinear, or any combination thereof.

In one embodiment, antenna 100 is constructed from 0.002" thick copper foil that is mounted on a thin plastic sheet.

As the copper thickness is changed, a minor retuning of either antenna portion (regions 102 or 104), or of a balun/impedance matching PCB, is typically required to re-establish the full performance of the SIR effect. The equivalent electronic thickness of antenna 100 can be increased (if desired) by bending the metallic edges at a right angle. Such an embodiment will have the greatest affect where the E-field, or the H-field, is the highest, such as near the bent dipole inner surfaces (high E-field), or near the outer edges of the loop antenna portion (high H-field).

Figure 10:
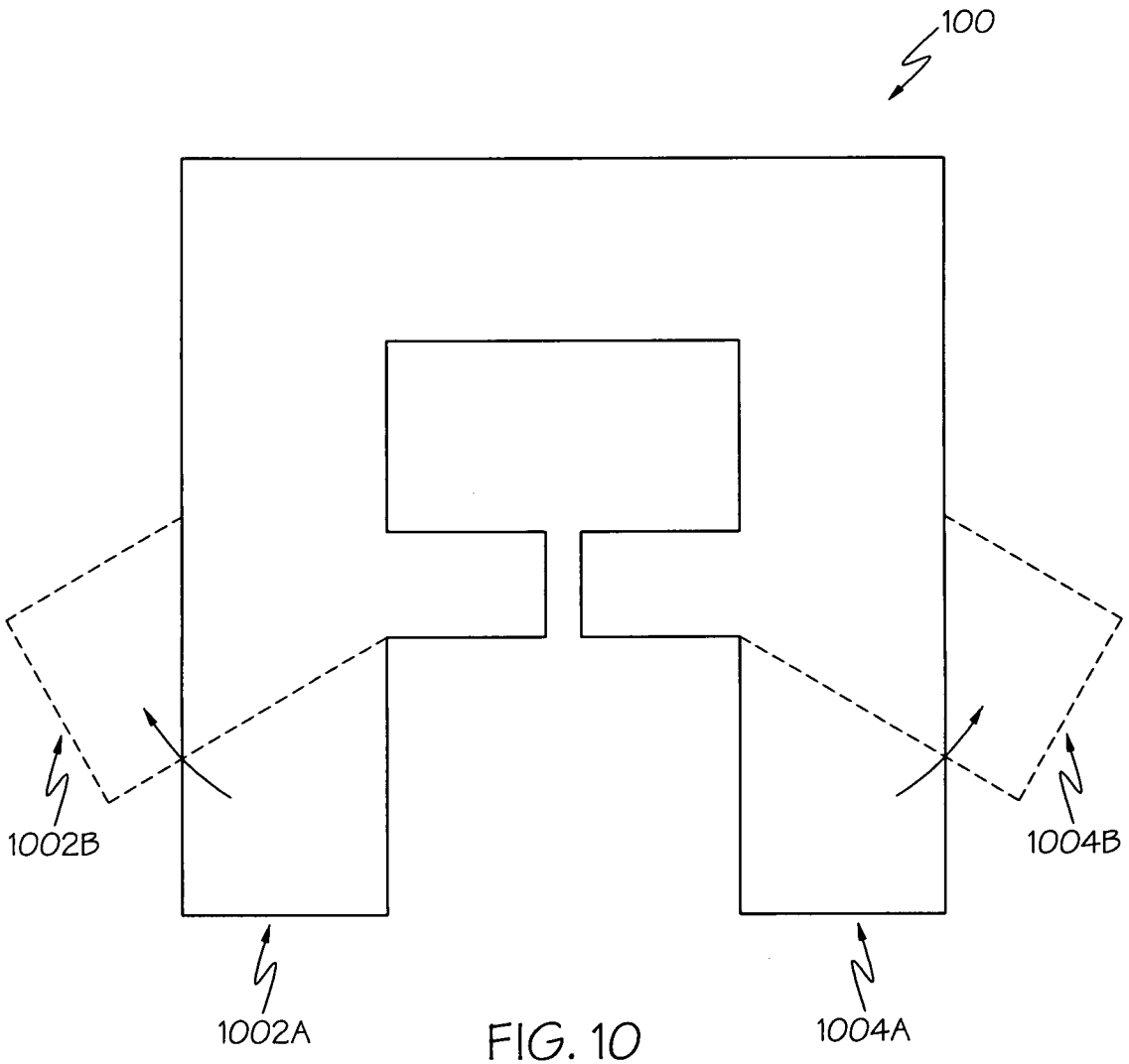
FIG. 10 depicts the antenna of FIG. 1 with rotated leg segments.

In various other embodiments, as depicted in FIG. 10, without changing the coplanar characteristics of antenna 100, region 104 may be constructed with different corner angles (e.g., greater or less than 90 degrees), so that the tips 1002 and 1004 are placed at a greater or smaller distance from each other (e.g., compare 1002A and 1002B). The greater or smaller spacing will change the frequency-swept input impedance of region 104. This in turn will typically require a modification of the radiating loop compensator portion so as to re-establish the opposing impedance characteristic that creates the SIR affect. The motivation for constructing such variations is to exercise the compromising parameters of physical size versus electrical performance, such as the bandwidth of −30 dB S11, for example.

It is also possible in various embodiments to bend or twist the tips 1002, 1004 such that they are non-coplanar with the rest of antenna 100—i.e., with both the tips bent in the same direction, or with the two tips bent in opposite directions. It is also possible to bend region 104 such that it is non-coplanar with the rest of antenna 100. Each of these modified versions will slightly change the cross-coupling coefficient between the antenna portions, and this in turn will require re-tuning of the various portions so as to re-establish the SIR effect.

Figure 6:
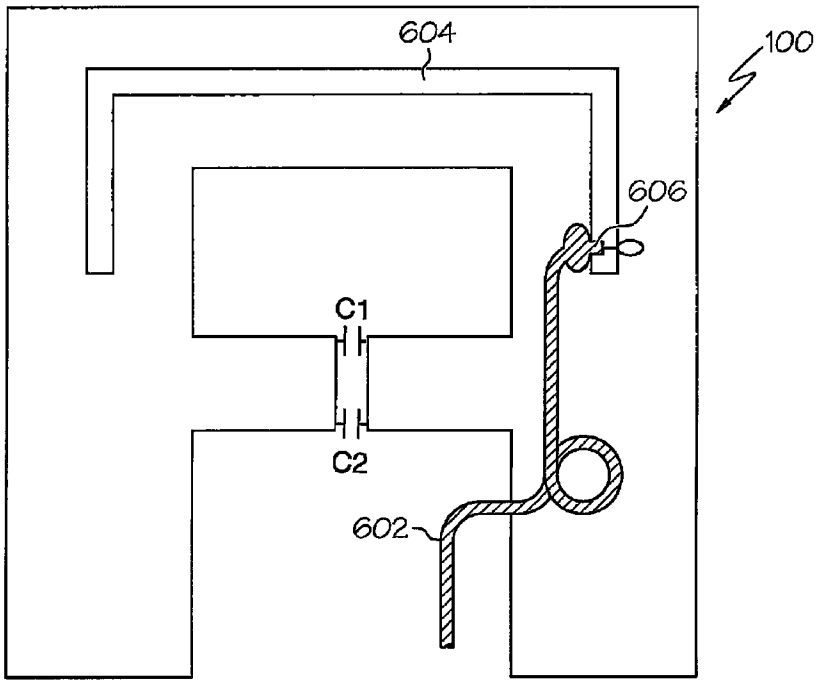
FIG. 6 depicts the antenna of FIG. 1 with a cable balun and vertically polarized slot.

In accordance with another embodiment, as shown in FIG. 6, a vertically polarized slot antenna 604 is formed within the area of the upper curved loop antenna region 102. Slot antenna 604 is excited with a coaxial cable balun 602 that bridges the slot near one of the shorted ends of the slot (e.g., at point 606). The coaxial cable balun 602 may be constructed using conventional procedures, such as coiling a section of the transmission line, applying a current transformer, ferrite devices, etc. The primary purpose of balun 602 is to de-couple the transmission line from the horizontally polarized radiation from antenna 100, which also has a separate transmission line, balun and impedance matching PCB. With proper deployment of the two transmission lines containing the two baluns, and because of the polarization orthogonality of the third portion of the antenna, it becomes possible to realize 30 dB of isolation between the vertical and horizontal antenna functions. This functional isolation allows antenna system 100 to radiate two separate signals, to transmit on one and receive on the other, or to radiate simultaneous signals that differ in amplitude and/or phase so as to create various kinds of linear (at various slant angles), elliptical, and circular polarizations (of either sense, CW or CCW).

In accordance with another embodiment, multiple antenna structures 100 are used to form a Yagi antenna. As is known, a Yagi antenna is a directional antenna type that typically consists of a dipole-like driven element and one or more passive parasitic elements that are usually mounted on a boom-like support structure. The parasitic element or elements that are mounted in the direction of the forward-propagated signal are called "directors."

The parasitic element that is mounted in the reverse direction is called the "reflector." For each Yagi design there is an ideal mounting position, diameter, and length, for each of the parasitic elements. The directors are usually electrically shorter than a resonant length, and thus they present a capacitive type of impedance, which has the affect of creating a slow wave structure for the free space wave that is propagating within that vicinity.

Correspondingly, the reflector is constructed to be electrically longer than a resonant length. A very high gain long Yagi design will consist of a large number of directors. Each director is allowed to have particular element spacing to the neighboring elements, and a particular element electrical length. Within such an antenna the designer has the freedom to set each element spacing (to control inter-element coupling) and length (to control the element reactance) so as to present a particular magnitude of the slow wave phenomenon that will exist for the free space wave that is propagating within the vicinity of those particular elements. The total Yagi design is intended to create a particular velocity profile along the length of the boom, which in turn determines the three dimensional radiated pattern characteristics of the Yagi antenna.

Figure 11:
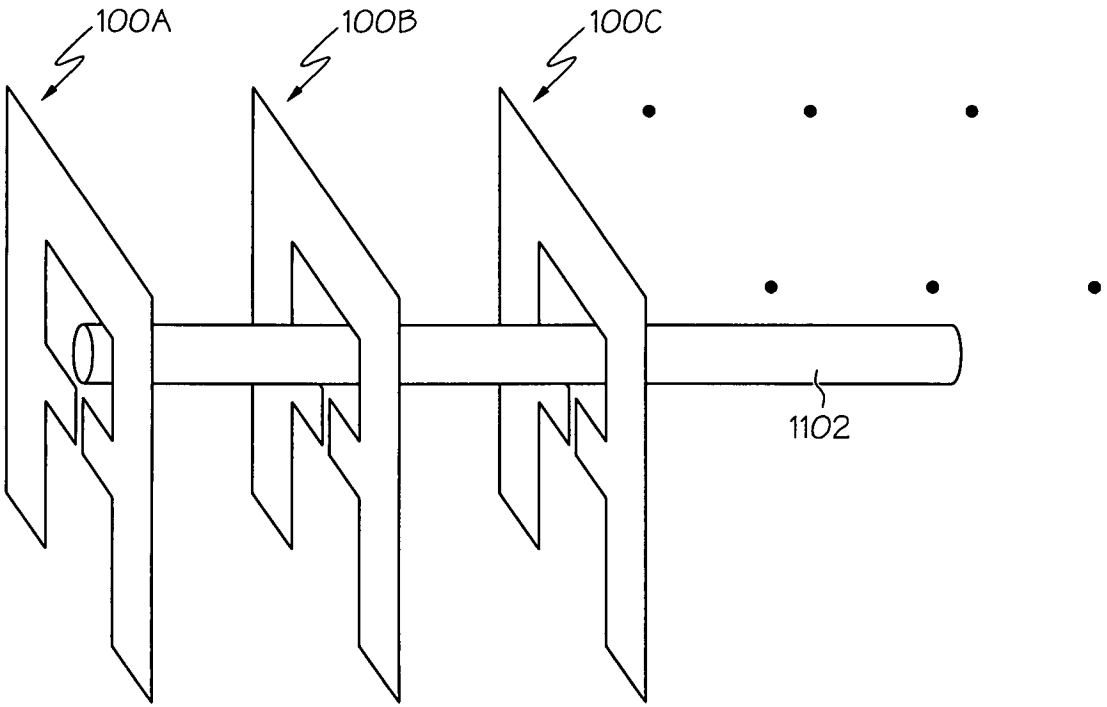
FIG. 11 illustrates a YAGI-like antenna in accordance with one embodiment of the invention.

Referring now to FIG. 11, in accordance with another embodiment of the present invention, a Yagi antenna includes multiple antennas 100 distributed along an orthogonal boom 1102. Such a configuration is capable of displaying a usable VSWR band width, and gain band width, of at least 13 percent. Those skilled in the art will realize that a Yagi antenna may be designed to emphasize any of the various traditional additional properties, and combinations of properties, such as: maximum gain; E-plane pattern; H-plane pattern; front-to-back (F/B) ratio; front-to-side ratio; side lobe levels; gain-to-temperature ratio, etc.

In an alternate Yagi embodiment, multiple reflector elements are mounted at a particular boom position, and one or more elements are mounted above and below the boom 1102 (i.e., a "trigonal reflector system). Embodiments may use different electrical length for the elements that are mounted above and below the boom so as to emphasize a particular performance, such as F/B ratio for the on-axis or off-axis pattern. Similarly, there is a potential benefit when parasitic (or active) elements are mounted laterally displaced from the center axis of the antenna. When an antenna 100 is used for the elements of such Yagi designs, it results in greater flexibility to control the desired performance, and to control that performance versus the swept frequency of excitation or reception.

Antenna 100 possesses two closely-spaced centers of radiation. The composite radiation pattern displays a moderate strength signal in the plus and minus broadside directions. The strongest radiation occurs within the plane of the copper foil in the direction of the U of region 104, and displays a partial null of a few dB in the direction that is toward region 102. There is a deeper null in the plane of the antenna, in the plus and minus directions that are normal to the axis of symmetry. When using this radiation pattern knowledge a Yagi antenna designer can decide to use the antenna 100 in multiple ways.

In conventional usage the plane of multiple Yagi elements consisting of antenna 100 will be mounted normal to the Yagi boom 1102. This technique allows the bi-directional element radiation to couple energy bi-directionally to the adjacent elements.

In an alternate embodiment the plane of the antenna 100 elements are parallel to boom 1102, with the maximum radiated pattern (the direction of the "U" of region 104) oriented in the Yagi forward direction. This design favors forward propagation while minimizing the inter-element coupling between each element in the rearward direction.

In another alternate embodiment, antenna 100 elements are tilted at an angle between normal and parallel configurations described above. In yet another embodiment, multiple antenna 100 elements (both active and parasitic elements) are mounted as described above, and are also mounted at off-boom locations, so as to tune the velocity profile for various regions along boom 1102 (and off boom 1102), and by using phased array techniques, so as to maximize a particular Yagi or Yagi array performance.

Figure 12:
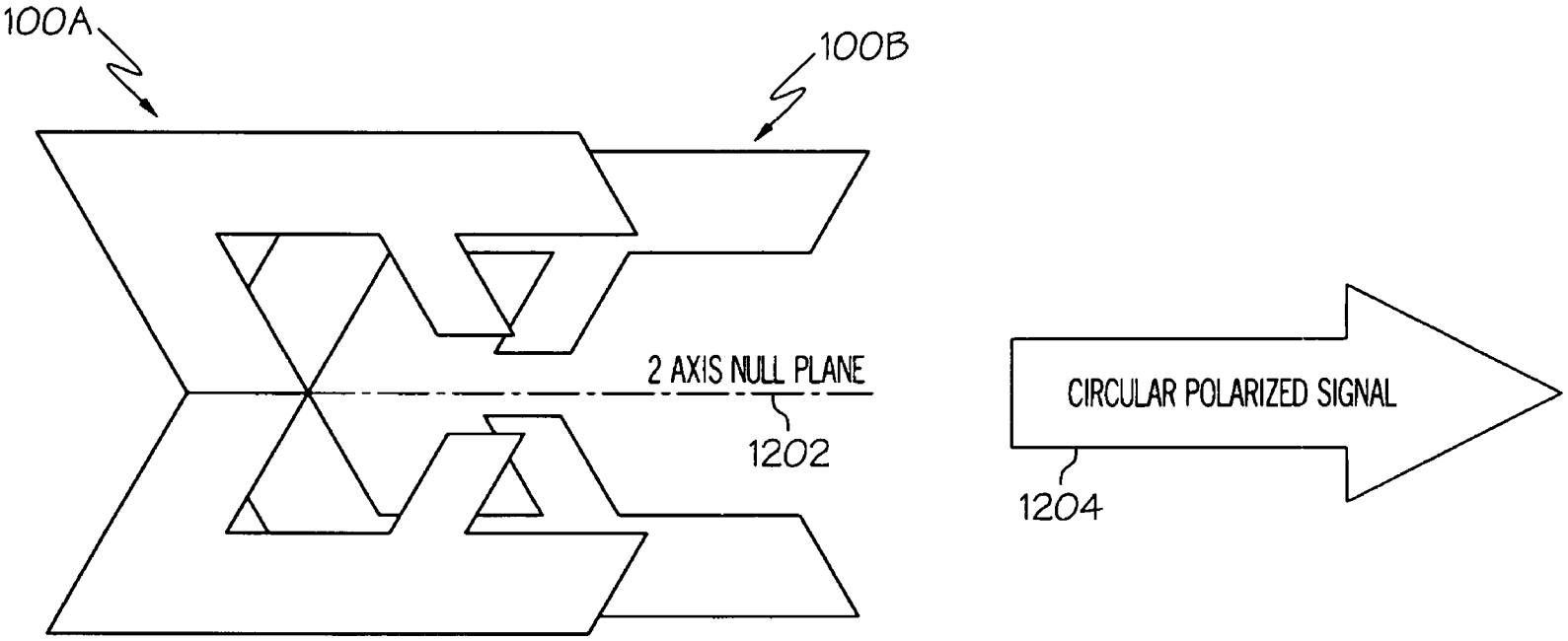
FIG. 12 illustrates the use of antennas in accordance with the present invention to produce a circular polarized signal.

In a further embodiment, referring now to FIG. 12, a pair of antennas 100A and 100B are mounted in a polarization orthogonal manner with respect to a two-axis common line of symmetry 1202. This results in a circular polarized signal that is bore-sighted in the direction 1204. Depending on the chosen method of mechanical construction, it may be required to mount one antenna ahead of the other, in the direction of propagation.

To generate a pure circular polarization (CP) signal, the two orthogonal antennas 100A and 100B will require an excitation signal such that the two radiated signals are in phase quadrature when viewed at a far field distance. The presence of the mechanical displacement in the propagation direction will simply require an adjustment of the phase of the excitation signals so as to generate the CP signal. For those skilled in the art it is a simple matter to adjust the individual signal amplitudes and phases so that all the polarization states (CP CW, CCW, Elliptical, Linear, Slanted Linear, etc.) can be generated.

In a further embodiment, a quadrature hybrid (similar to that of a balanced amplifier) is provided between a pair of antenna 100. For an explanation: a Kurokawa Amplifier—often called a Balanced Amplifier—is one that contains a matched pair of amplifiers that are connected to a pair of well-balanced Quadrature Hybrid circuits. The advantage of such an arrangement is an extreme improvement of the resultant input impedance, the output impedance, and an amplifier with twice the power output capability. The use of a quadrature hybrid that is preceding a pair of antenna 100 will take the superior S11 performance of each antenna 100 and further improve the S11 performance. The net result will be either a two element phased array antenna, or a circular polarized antenna that has a considerably improved VSWR magnitude, and an expanded VSWR band width.

A balun circuit and an impedance matching circuit may be constructed in many different ways. In the present embodiment, such functions are supplied by a separate PCB (not shown) that is attached to the copper foil composite antenna structure 100. Those same functions can be constructed within the copper foil composite antenna structure by the use of known techniques, such as micro-strip, strip-line, coplanar wave guide, coplanar wage guide plus ground plane, suspended substrate transmission lines, fin line, slot line, attached semi-rigid (and flexible) coaxial transmission lines, and frequency selective surface techniques.

One of the methods of creating a direction finding (DF) system is to use multiple antenna elements in an interferometry manner, or in a phased array manner. In that application multiple antenna array elements that are horizontally and/or vertically displaced are combined into a receiving system. The receiving system combines the multiple signals from the antenna array elements in such a way that either a phase difference, an amplitude difference, or a time of arrival difference is derived within the receiver system (depending the DF technique that is being used) as the direction of arrival of the signal of interest is changed.

It is desirable that the individual antenna elements of the DF array display unchanging impedance, an unchanging phase difference, and an unchanging change in phase center as the frequency of operation is swept. Ideal individual DF array elements should also posses a three dimensional directivity pattern that favors the direction of signal arrival, and has a pattern null in the direction of the other elements so as to maximize the isolation between the array elements. Isolation is important because the lack of isolation is one of the major causes of DF measurement error. Accordingly, antenna structures in accordance with the present invention are very desirable for a horizontally polarized DF system that measures azimuth by the use of horizontally displaced elements since the antenna 100 elements display a pattern null in the plane of the antenna, in the directions that are normal to the plane of symmetry. Such antenna 100 structures can also be used in a vertically polarized elevation measuring DF system by rotating the complete array of antenna 100 elements go degrees about a line normal to the plane of an antenna 100.

The nature of this design and its advantageous results have not previously been realized for a number of reasons. First, currently available antenna modeling programs are essentially inoperative when conductors of such widths in wavelengths, i.e., 0.12 lambda and greater, are being used, and under that condition they do not have enough modeling accuracy to resolve an S11 of −30 dB.

Second, there are misinformed popular opinions among antenna engineers who believe that using an unusually wide antenna element (a) lowers the element insertion loss or dissipation (which is true), (b) lowers the element Q (which might be true), (c) results in more loss (which is not true), (d) are usually undesirable (not true), (e) is beyond the law of diminishing returns because the loss has already been minimized (which is not true), and (f) results in are no other benefits to be had when using unusually wide elements (which is not true).

Furthermore, many antenna engineers have not realized that using unusually wide elements within an antenna will enable new antenna tuning capabilities. Such antennas behave differently than narrow elements, and the difference becomes more dramatic when they are operated over a range of frequencies. Such elements partially operate in a condition that is similar to "the RF skin effect," wherein the local currents and magnetic fields near the edges of a wide flat element are considerably higher than in more-central areas, and the currents change in a controllable manner as the frequency is changed.

By controlling the width, shape and possible cutouts within certain regions of an extremely wide flat antenna element, a person skilled in the art can change the local current magnitude, the rate of change in the local current magnitude, the local current distribution, the rate of change in the local current distribution, the coupling coefficient between adjacent elements, and the rate of change of the coupling coefficient—all of these as the frequency of operation is changed. These techniques have a similarity to the methods used in designing Frequency Selective Surfaces. Such techniques will allow the designer to synthesize equivalent RF reactive components, where each reactance can be made to change in an unusual way versus the operating frequency. Until recently, these meta material-like antenna elements, and RF reactive component-like sections that can be formed within an element were not realizable by conventional means.

While at least one example embodiment has been presented in the foregoing detailed description, it should be appreciated that a vast number of variations exist. It should also be appreciated that the example embodiment or embodiments described herein are not intended to limit the scope, applicability, or configuration of the invention in any way. Rather, the foregoing detailed description will provide those skilled in the art with a convenient and edifying road map for implementing the described embodiment or embodiments. It should be understood that various changes can be made in the function and arrangement of elements without departing from the scope of the invention and the legal equivalents thereof.

What is claimed is:

1. An antenna comprising:

a dipole radiator region comprising a series resonant tank; and a loop compensator/radiator region integral with the dipole radiator region and comprising a parallel resonant tank;

wherein the series resonant tank and the parallel resonant tank are electrically connected in parallel, and wherein each region is configured such that the reactive portions of the tank of each region change in a complementary manner to cancel each other, and a total composite resistance of the combined parallel fed regions remains substantially constant as an input frequency of the antenna deviates from a designed center frequency within an operating bandwidth of the antenna;

wherein the dipole radiator region and the loop compensator/radiator region compose an "A"-shaped structure with two straight continuous legs lying across both regions and with a discontinuity in a central horizontal segment, wherein the antenna includes a common input point at the discontinuity; and a balun component coupled to the common input point at the discontinuity, and further including a first compensating capacitor placed across the discontinuity closest to the dipole radiator region and a second compensating capacitor placed across the discontinuity closest to the loop compensator/radiator region to provide the substantially constant resistance over the operating bandwidth of the antenna.

2. The antenna of claim 1, wherein the dipole radiator region is configured to yield a capacitive reactance in its input impedance when the applied frequency is lower than the resonant frequency and the loop compensator/radiator region is configured to yield an inductive reactance of its input impedance when the input frequency is lower than the designed resonant frequency.

3. The antenna of claim 1, wherein the loop compensator/radiator region has a circumference that is less than one resonant wavelength of an operating frequency of the antenna, and the dipole radiator region has a length that is less than one resonant half-wavelength of an operating frequency of the antenna resistive.

4. The antenna of claim 3, wherein the dipole radiator region and the loop compensator/radiator regions provide cross-coupling therebetween.

5. The antenna of claim 1, wherein the capacitors and their positioning across the discontinuity is configured to provides −30 dB reflection coefficient over a 13% bandwidth.

6. The antenna of claim 1, wherein the antenna has a planar conductive sheet configuration and wherein the discontinuity has a gap of about 0.085 inches.

7. The antenna of claim 1, wherein in the "A"-shaped structure, the legs are parallel to the axis of symmetry of the antenna.

8. The antenna of claim 1, wherein the loop compensator/radiator incorporates a slot antenna, and wherein the dipole radiator region and the loop compensator/radiator region have a second input point near a shorted end of the slot antenna, and wherein the slot antenna is driven independently from, and provide a separate signal from, the antenna and provides a signal polarization orthogonal to the antenna.

9. A method for receiving and transmitting RF energy, comprising: printing a conductive sheet antenna having a dipole radiator region comprising a series resonant tank, and a loop compensator/radiator region contiguous with the dipole region and comprising a parallel resonant tank, such that the series resonant tank and the parallel resonant tank are electrically connected in parallel, and wherein each region is configured such that the reactive portions of the tank of each region change in a complementary manner to cancel each other, and a total composite resistance of the combined parallel fed regions remains substantially constant as an input frequency of the antenna deviates from a designed center frequency within an operating bandwidth of the antenna;

coupling a conductor to a selected point on the printed sheet antenna; and sending and receiving an RF signal via the selected point;

wherein the dipole radiator region and the loop compensator/radiator region compose an "A"-shaped structure with two straight continuous legs lying across both the dipole radiator and the loop compensator/radiator regions and with a discontinuity in a central horizontal segment, wherein the antenna includes a common input point at the discontinuity; and coupling a balun component to the common input point at the discontinuity, and placing a first compensating capacitor across the discontinuity closest to the dipole radiator region and a second compensating capacitor across the discontinuity closest to the loop compensator/radiator region to provide the substantially constant resistance over the operating bandwidth of the antenna.

10. The antenna of claim 1, further comprising a second antenna with the same configuration as the antenna, and wherein the two antennas are mounted in a polarization orthogonal manner with respect to a two-axis common line of symmetry to provide a circular polarized signal that is aligned along the common line of symmetry.

* * * * *